US005890918A

United States Patent [19]

Hierzer

[11] Patent Number: 5,890,918

[45] Date of Patent: Apr. 6, 1999

[54] LOW VOLTAGE CURRENT SUPPLY DEVICE

[76] Inventor: Andreas Hierzer, Neupauerweg 81, A-8052 Graz, Austria

[21] Appl. No.: 793,425

[22] PCT Filed: Nov. 29, 1995

[86] PCT No.: PCT/AT95/00234

§ 371 Date: Feb. 25, 1997

§ 102(e) Date: Feb. 25, 1997

[87] PCT Pub. No.: WO96/17414

PCT Pub. Date: Jun. 6, 1996

[30] Foreign Application Priority Data

Dec. 1, 1994 [AT] Austria ..... 2231/94

[51] Int. Cl.[6] ..... H01R 25/00

[52] U.S. Cl. ..... 439/110; 439/122; 439/414

[58] Field of Search ..... 439/110, 121, 439/122, 411, 412, 414, 425, 116, 119, 120; 174/98

[56] References Cited

U.S. PATENT DOCUMENTS

| | | | |
|---|---|---|---|
| 3,372,361 | 3/1968 | Wengen | 439/412 |
| 3,391,377 | 7/1968 | Corl et al. | 439/121 |
| 3,663,924 | 5/1972 | Gerlat | 439/411 |
| 4,120,554 | 10/1978 | Bianchi et al. | 439/411 |
| 4,812,134 | 3/1989 | Miller et al. | 439/110 |
| 5,460,539 | 10/1995 | Gallone | 439/425 |

FOREIGN PATENT DOCUMENTS

| | | | |
|---|---|---|---|
| 1000459 | 12/1988 | Belgium . | |
| 0453725 | 10/1991 | European Pat. Off. | H01R 25/14 |
| 2303400 | 10/1976 | France | H02G 5/04 |
| 3214911 | 10/1983 | Germany | H01R 25/14 |
| 4214005 | 12/1992 | Germany | H01R 25/14 |
| 4302560 | 4/1994 | Germany | H01R 25/14 |
| 0888213 | 1/1962 | United Kingdom . | |

*Primary Examiner*—Neil Abrams
*Assistant Examiner*—Brian J. Biggi
*Attorney, Agent, or Firm*—Ladas & Parry

[57] ABSTRACT

Current Supply Device for Low Voltage Equipment There is disclosed a current supply device for low voltage equipment, in particular for supplying lighting fixtures, provided with at least one conductor rail (1; 1'; 1"; 1'") in the form of a section (2; 2'; 2"; 2'") having at least one longitudinal slot (3, 3'*a*, 3'*b*; 3"*a*, 3"*b*; 3'") in which at least one current conductor (6; 6'; 6"; 6'*a*, 6'*b*; 6"*a*, 6"*b*; 6'"*a*, 6'"*b*) is arranged which is capable of being contacted with a current collector (10; 10', 10"; 10'") that has a thread serving as a mechanical holding element and which is capable of being screwed into the longitudinal slot; preferably, the current conductor is arranged at the bottom portion (4, 4'*a*, 4'*b*) of the longitudinal slot (3; 3'*a*, 3'*b*) and is insulated on all sides by soft synthetic material or soft rubber, and the current collector (10) has a contact at its front side designed as a spike (14) which penetrates the insulation of the current conductor when the thread is screwed in. The side walls (8) of the longitudinal slot (3) may comprise flutes (9) corresponding to the thread of the holding element (11).

26 Claims, 5 Drawing Sheets

LOW VOLTAGE CURRENT SUPPLY DEVICE

The invention relates to a low voltage current supply device which is provided with at least one conductor rail comprising parallelly extending, insulatedly interconnected current conductors capable of being contacted by current collectors to which current consumers are connectable, the conductor rail being designed as a section having at least one longitudinal slot, at least one current conductor being arranged in this longitudinal slot. Such current supply decives are particularly provided for supplying lighting fixtures.

In most instances, the known current supply devices for low voltage comprise one or several conductor rails connected to a transformer which transforms the mains alternating voltage to a low voltage of 12 V, e.g., with which low voltage lighting fixtures, e.g. halogen bulbs, are supplied. The conductor rails of the known devices are not insulated towards the outside, which is not dangerous in terms of possibly touching them because of the low voltage applied. Yet on account of the possiblity of metallic objects contacting both current conductors of a conductor rail and causing short circuits, damage may be caused both in the device itself and in its surroundings. In DE 39 19 201 A, e.g., a conductor rail having this drawback is disclosed, in which two rods forming the conductor rail are interconnected by means of synthetic material pins. The rods are arranged so as to be readily accessible from all sides, the danger of a short circuit thus being very great.

From DE 42 14 005 A1, a low voltage conductor rail designed as a metal tube having a longitudinal slot is known, which internally carries a copper wire enveloped by an insulating strip; a spring-loaded contact pin being contacted therewith. Fixing of the current collector on the metal tube is effected by a rectangular platelet integrally molded on a cylinder which is connected with the tube of the lighting fixture. During mounting, the platelet is inserted in the longitudinal slot of the rail with its narrow side and subsequently is rotated by 90°, thus being supported on the undercuts of the longitudinal slot. To fix the platelet in this position, a sleeve which can be slid over the cylinder is provided, which is coupled with the tube of the lighting fixture via a threaded bushing, rotation of the threaded bushing pressing the platelet against the undercuts. With this relatively complicated structure of the current collector, the contact pin is electrically insulatedly guided through a bore in the platelet and in the pin of the cylinder. This also has the disadvantage that the platelet will bend when the threaded bushing is turned too much, and will get into contact with the contact pin by means of the rim of the bore, resulting in a short circuit.

It is an object of the invention to provide a conductor rail of the initially defined type in which the disdadvantages inherent in the known conductor rails are avoided. In particular, simple contacting shall be enabled with a simple structure, and furthermore the danger of short circuits is to be practically excluded.

According to the invention, this object is achieved in that the individual current collectors have a thread as a mechanical holding element, which thread, by being capable of being screwed into the longitudinal slot, engages with the oppositely arranged side walls of this longitudinal slot. By using a current collector holding element capable of being screwed into a section, the entire conductor rail can have a simple structure, and it can be readily produced at relatively little expenditure.

According to a preferred embodiment, a current conductor is arranged at the bottom portion of the longitudinal slot.

By this measure, the current conductor is mounted well protected within the conductor rail.

In an advantageous embodiment of the invention it is provided that several, e.g. two, longitudinal slots in which current conductors are arranged, are adjacently provided in the section forming the conductor rail on one side of the section. This results in the advantage that the conductor rail does not have any outwardly arranged live portions. Furthermore, simple positioning and attaching of the current collectors results.

To increase the carrying capacity of the current collectors, e.g. with a view to the mounting of lighting fixtures, it is suitable if the section forming the conductor rail has an approximately H-shaped cross-section comprising longitudinal slots extending into the section from sides which face away from each other, current conductors being arranged in said longitudinal slots. This configuration of the conductor rail furthermore offers increased design possibilities.

To reduce the total dimensions it is advantageous if several current conductors are arranged in one longitudinal slot.

A particularly compact and simple structure of the conductor rail and of the current collector can be achieved in that the section forming the conductor rail is a metal section and that the at least one current conductor is insulatedly arranged in the longitudinal slot(s).

To provide the contact between current conductor and current collector it is particularly advantageous if the insulation of the current conductor keeps clear at least one side thereof which is accessible from the longitudinal slot.

To obtain good insulation which is easy to make it is provided for the current conductor(s) to be insulated on all sides with soft synthetic material or soft rubber. To collect current, a spike penetrating the insulation is guided to the respective current conductor.

To mechanically secure the current conductor in the conductor rail, it is furthermore advantageous if the current conductor provided with an insulation is arranged in a groove located in the wall of the longitudinal slot and provided with lateral undercuts and extending in the longitudinal direction of the section and is positively retained in the groove by these undercuts.

To mechanically secure the current conductor, it is also suitable if the current conductor provided with an insulation has an approximately circular cross-section and is positively held in a groove of sector-shaped cross-section in the wall of the longitudinal slot, which groove extends over an angle of more than 180° relative to the geometric axis. Common insulated wires can be used as pre-material for the current conductors, which are practically available everywhere in various dimensions and embodiments, so that low production costs result.

A favorable solution in respect of the compact embodiment of the current collector and attachment of lighting fixtures sought for is obtained if the metal section itself also forms a current conductor.

According to a further embodiment which allows for a low-cost production of the section and for an immediate installation of the current conductors without separate insulating elements is characterised in that the section forming the conductor rail is a synthetic material section in which several, e.g. two, current conductors are arranged so as to be insulated from one another.

For an easy positioning of the current collectors it may advantageously be provided for the oppositely arranged side walls of the longitudinal slot(s) to comprise flutes following upon each other in the direction of the depth of the longitudinal slot(s) and corresponding to the pitch of the thread of the holding element, the thread engaging in said flutes when being screwed into the respective longitudinal slot. The thread elements of the current collectors can readily be shifted in the longitudinal slots following the direction of the slot over any desired distance as far as to the desired position and subsequently be tightly screwed in, since the convolutions engage in the flutes.

A particularly preferred, structurally extremely simple embodiment of the current collector is obtained if the thread of the current collector on its front side carries a contact provided for contacting a current conductor arranged in the longitudinal slot, which contact is insulatedly arranged and connected with a lead leading out of the longitudinal slot region. This provides for a good electrically conductive connection between the current conductor and the current collector.

According to a preferred embodiment of the current collector it is provided for the contact to be designed as a spike axially projecting from the front side of the thread. This results in a particularly favorable contact between the current collector and a current conductor insulated, e.g., with soft synthetic material or soft rubber, since the spike passes through the insulation thereof and penetrates into the current conductor.

In a variant of the current collector, the contact is desigend as one or several contact finger(s) pivotable about the geometric thread axis and projecting in radial direction. This embodiment is advantageous if the current conductor is arranged at the side wall of the longitudinal slot of the conductor rail.

A compact and structurally simple embodiment is enabled in that the current collector is the carrier for a lighting fixture.

The invention will now be further explained in more detail by way of exemplary embodiments schematically illustrated in the drawings.

Figure 1:
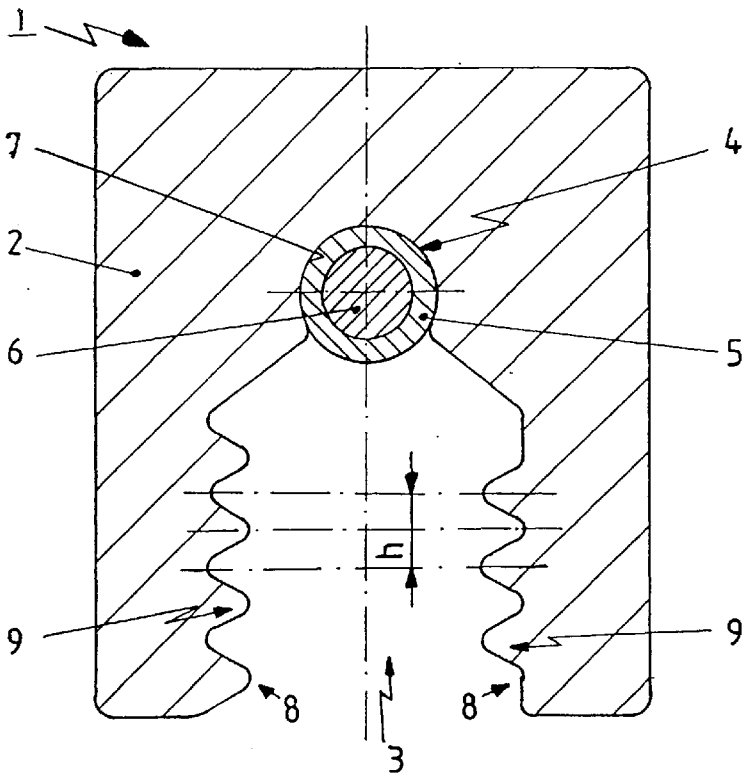
FIG. 1 shows a cross-section and partly a longitudinal section of a first embodiment of a conductor rail with a current collector prior to installation.
Figure 1:
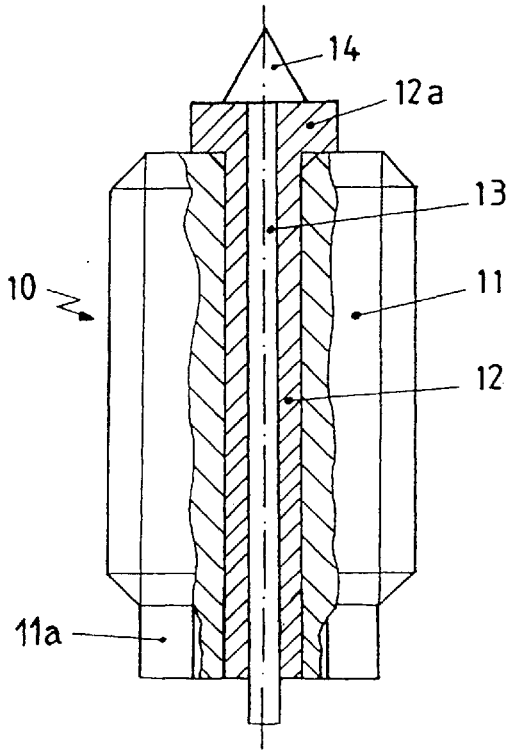

In FIG. 1, a conductor rail in form of a rectangle-shaped section 2 is denoted by 1, the section 2 having a downwardly opening longitudinal slot 3. At the bottom part 4 of the longitudinal slot 3, a current conductor 6 provided with an insulation 5 is inserted in a groove 7 of sector-shaped cross-section, the sector extending over an angle of more than 180°, whereby an undercut is formed by which the current conductor 6, or the insulation 5 thereof, respectively, is retained after having been inserted in the groove 7 by pressing in. On the side walls 8 of the longitudinal slot 3, oppositely arranged flutes 9 which are offset by the pitch h of a thread are provided which continue in the direction of the depth of the longitudinal slot 3. The transition from the groove opening to the side walls 8 is inclined.

A current collector 10 provided for insertion in the longitudinal slot 3 is designed as a mechanical holding element including a screw 11 whose pitch corresponds to the above-mentioned pitch h, i.e. the screw 11 may either be inserted in the longitudinal slot 3 at the ends of the section 2 and shifted to any desired position, or the screw 11 is rotated in between the flutes 9 at the desired position. For this purpose, the screw 11 may comprise a square or hexagon neck 11*a*, e.g., at its lower end.

The screw 11 has an axial bore for accommodating an insulation tube 12 provided with a bead 12*a* at its upper end, a contact pin 13 being inserted in this insulation tube so as to protrude from the ends thereof, the parts 11 to 13 being preferably interconnected by press fit. At the end of the contact pin 13 oriented towards the longitudinal slot 3, the former is designed as a spike 14 supported on the bead 12*a* of the insulation tube. The other, free end of the contact pin 13 serves for connection with a continuing cable to the current consumer, the cable being connectable with the contact pin 13 in a known manner, by soldering, clamping, screwing or the like.

Figure 2:
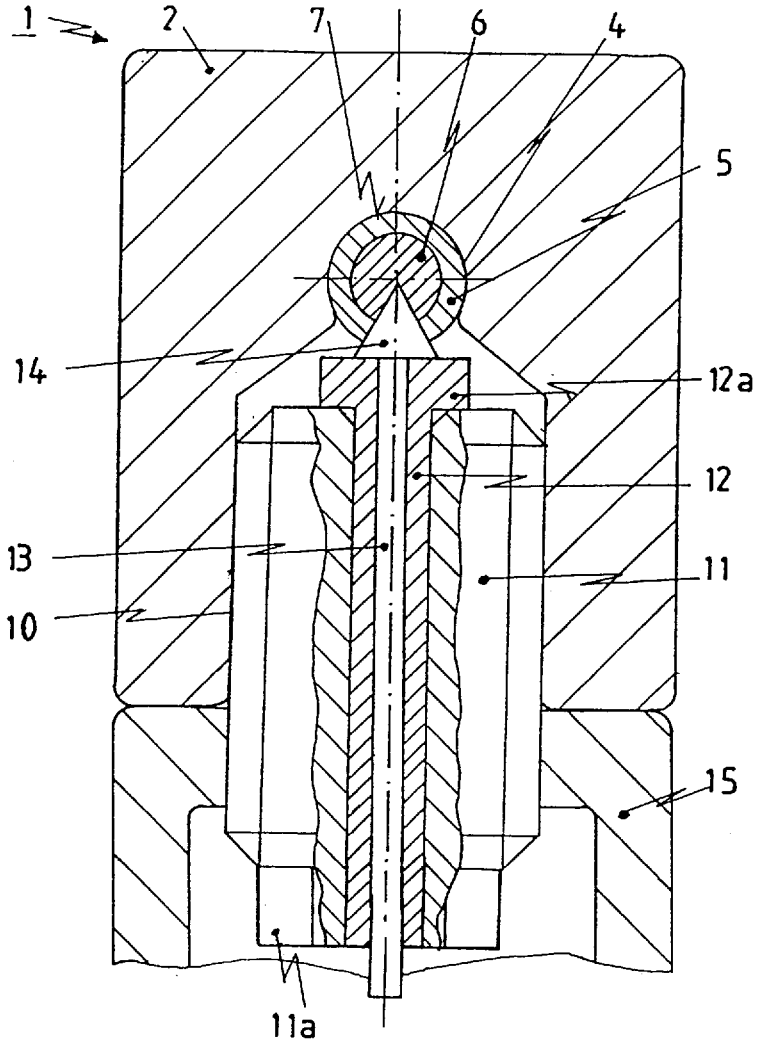
FIG. 2 shows a cross-section and partly a longitudinal section of the conductor rail with the current collector according to FIG. 1 in the assembled state.

FIG. 2 shows the current collector 10 completely screwed into the flutes 9 of the longitudinal slot 3, the spike 14 of the contact pin 13 having pierced the insulation 5 and penetrated into the current conductor 6.

To the residual portion of the screw 11 projecting from the longitudinal slot 3, a light holding means 15 having an inner thread may be scewed.

Figure 3:
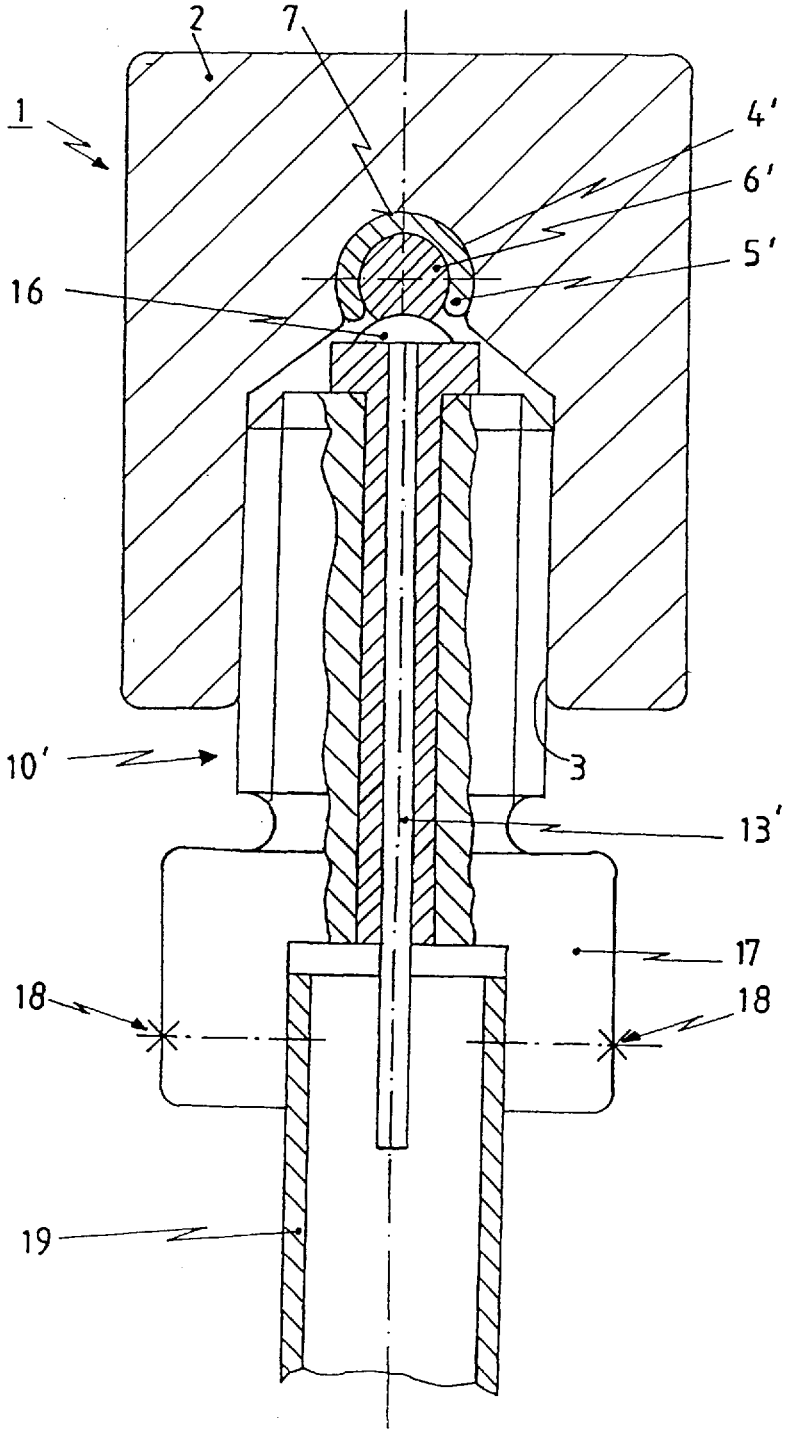
FIG. 3 shows a cross-section and partly a longitudinal section of a second embodiment of a conductor rail with a current collector in the assembled state.

FIG. 3 shows a conductor rail 1 according to another embodiment, in which the current conductor 6 has an insulation 5' in the groove 7, which only extends as far as to the inclined transition between the groove 7 and the longitudinal slot 3, the exposed uninsulated portion of the current conductor 6 being electrically connected with a contact cap 16 of a contact pin 13'. At its lower end, the screw 11' of the current collector 10' has a pot-shaped projection 17 provided as a holding means for a carrying tube 19 for a lighting fixture inserted therein and secured by means of radial screws 18. In this case, the contact pin 13' projects into the cavity of the pot-shaped projection 17 to be accordingly connected with a cable or the like.

Figure 4:
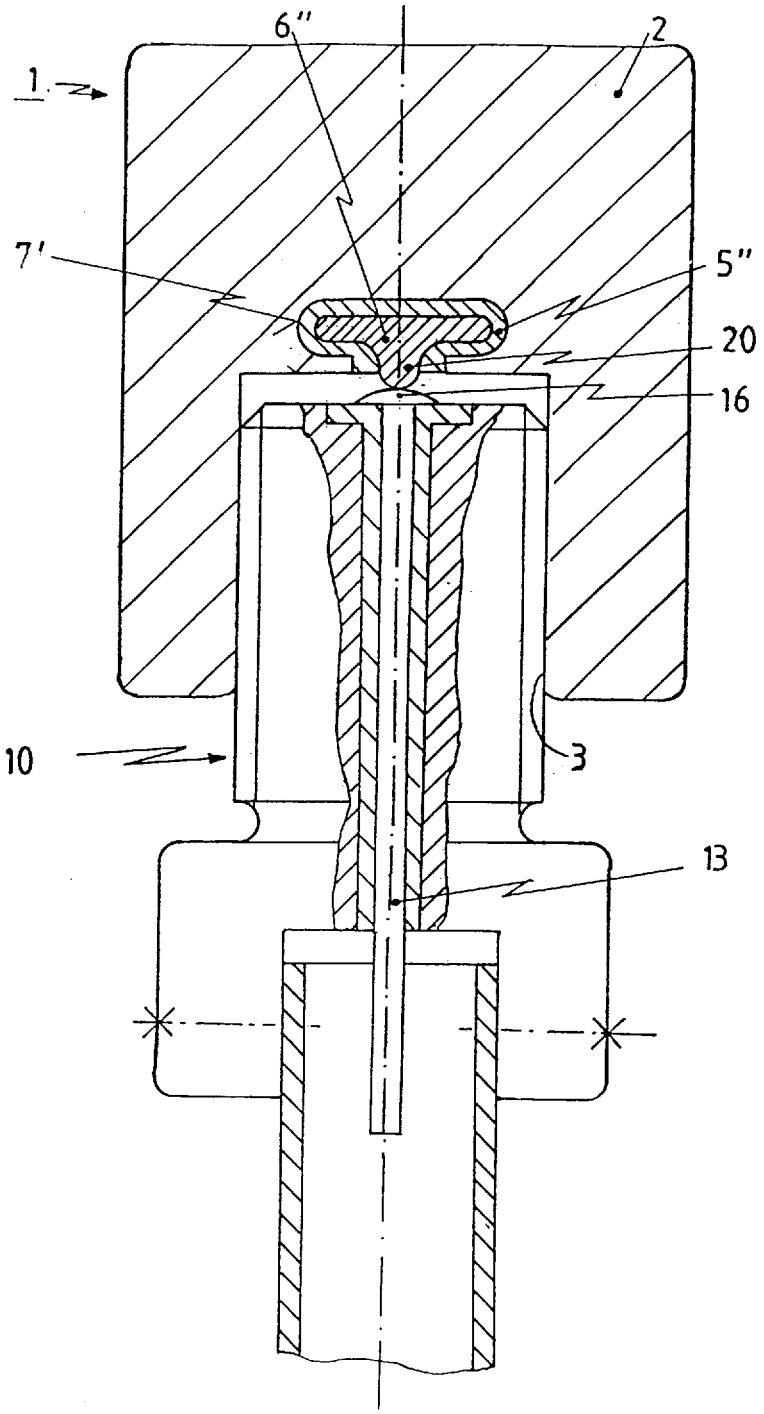
FIG. 4 shows a cross-section of a third embodiment of a conductor rail with a current collector in the assembled state.

In the embodiment of the conductor rail 1 according to FIG. 4, the current conductor 6' has a T-shaped cross-section surrounded by an insulation 5" extending only as far as to the downwardly projecting web 20 of the current conductor 6' and inserted into a T-shaped groove 7'. The lower free end of the web 20 of the current conductor 6' is electrically connected with a contact cap 16" of the contact pin 13". The current collector 10" is designed in the same manner as the current collector 10' according to FIG. 3, so that a description thereof is not required.

In the embodiments according to FIGS. 1 to 4, the conductor rail is preferably made of a conductive aluminum section, whereas in the following embodiments according to FIGS. 5 to 7 the conductor rail is made of an insulating synthetic material section.

Figure 5:
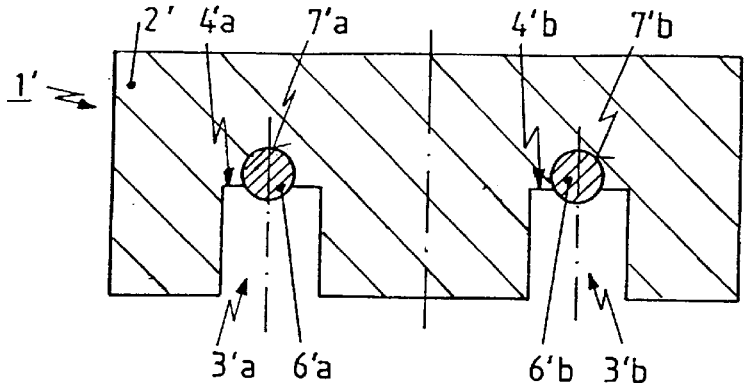
FIG. 5 shows a cross-section of a fourth embodiment of a conductor rail.

The conductor rail 1' according to FIG. 5 consists of a rectangular section 2' comprising two downwardly open longitudinal slots 3'*a*, 3'*b*. At the bottom portion 4'*a*, 4'*b* of the longitudinal slots 3'*a*, 3'*b*, uninsulated current conductors 6'*a*, 6'*b* are inserted in respective grooves 7'*a*, 7'*b* of sector-shaped cross-section, the sectors extending over an angle of more than 180° so that again an undercut is formed to retain the current conductors 6'*a*, 6'*b*, which are inserted by pressing them into the grooves 7'*a*, 7'*b*. Current collectors with screws (not illustrated) having a self-cutting thread or a thread similar to that of a sheet metal screw can be inserted in the longitudinal slots 3'*a*, 3'*b*.

Figure 6:
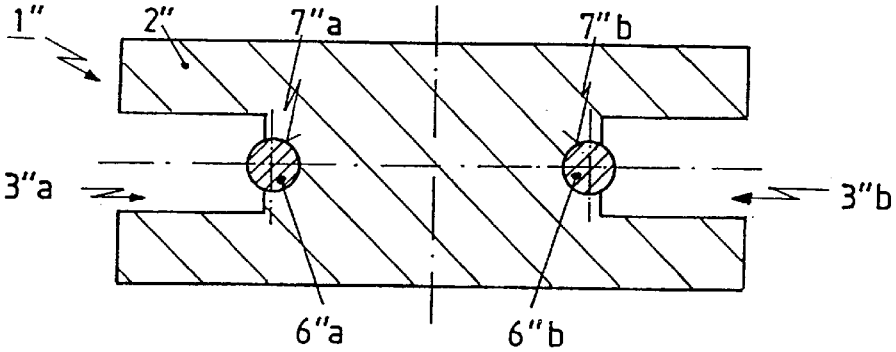
FIG. 6 shows a cross-section of a fifth embodiment of a conductor rail.

In principle, the conductor rail 1" according to FIG. 6 is of similar construction as the conductor rail 1' according to FIG. 5, yet its longitudinal slots 3"*a*, 3"*b* are located in the side portions of the section 2".

Figure 7:
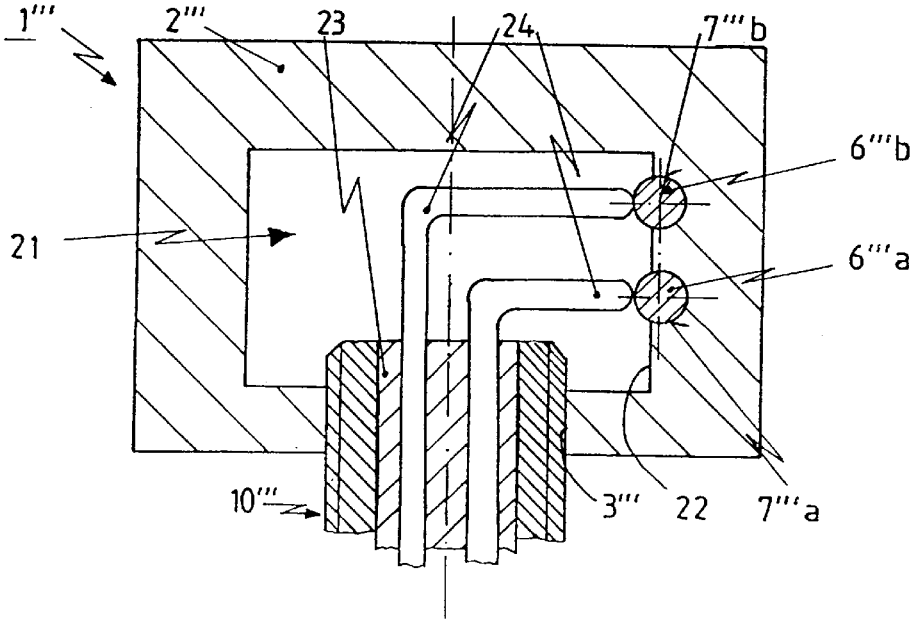
FIG. 7 shows a cross-section of a sixth embodiment of a conductor rail.

In the conductor rail 1'" according to FIG. 7, the section 2'" has a longitudinal slot 3'" at its lower side, which slot merges inwardly into a rectangular cavity 21. On one side wall 22 of the cavity 21, two uninsulated current conductors are adjacently inserted in a groove 7'"*b* of sector-shaped cross-section in a manner as has been described by way of the previous embodiments. In the longitudinal slot 3'", the thread portion of a current collector 10'" having a self-cutting thread is screwed in, in which an axially mounted insulating bushing 23 is rotatably journaled. The radially angled free ends of two contact fingers 24 are embedded in the insulating bushing 23 which may be brought into or out of contact with the respective current conductors 6'"*a* and 6'"*b* by rotation of the insulating bushing 23.

I claim:

1. A low voltage power supply device, comprising:

at least one elongated section-type conductor rail made of metal and having at least one slot longitudinally extending along the at least one elongated section-type conductor rail, the at least one slot having two opposed side walls;

and in the at least one slot there being arranged at least one longitudinally extending current conductor having an electrical insulation; and at least one electrical collector having an externally threaded body capable of being screwed into the at least one slot by engaging into the two opposed side walls of the at least one slot; wherein the at least one electrical collector further comprises at least one electrically conducting element which contacts the at least one longitudinally extending current conductor within the at least one slot when the respective collector is screwed into the at least one slot.

2. The device according to claim 1, wherein the two opposed side walls of the at least one slot comprise flutes following upon each other in the direction of the depth of the at least one slot and corresponding to a pitch of a thread of the externally threaded body, and wherein the thread of the externally threaded body engages the flutes when being screwed into the at least one slot.

3. The device according to claim 1 or 2, wherein the at least one elongated section-type rail itself also forms a current conductor.

4. The device according to claim 1 or 2, wherein the at least one longitudinally extended electrically insulated current conductor is arranged at a bottom part of the at least one slot.

5. The device according to claim 1 or 2, wherein a first one of the at least one slot is arranged adjacent to a second one of the at least one slot on one side of the at least one elongated section-type conductor rail.

6. The device according to claim 1, wherein the at least one elongated section-type rail has an approximately H-shaped cross-section in which a first one of the at least one slot faces away from a second one of the at least one slot.

7. The device according to claim 6, wherein the at least one longitudinally extending current conductor has an approximately circular cross-section and is positively held in a groove located in a first one of the two opposing side walls of the at least one slot, wherein the groove extends over an angle of more than 180° relative to the geometric axis of the at least one longitudinally extending current conductor.

8. The device according to claim 1, wherein the electrical insulation keeps clear at least a portion of the current conductor, the portion being accessible from the at least one slot.

9. The device according to claim 8, wherein the at least one longitudinally extending current conductor has an approximately circular crosssection and is positively held in a groove located in a first one of the two opposing side walls of the at least one slot, wherein the groove extends over an angle of more than 180° relative to the geometric axis of the at least one longitudinally extending current conductor.

10. The device according to claim 1, wherein the electrical insulation is made of soft synthetic material or soft rubber and covers the entirety of the at least one longitudinally extending current conductor.

11. The device according to claim 1, wherein the at least one longitudinally extending current conductor is arranged in a groove located in a first one of the two opposing side walls of the at least one slot and is positively retained in the groove by lateral undercuts.

12. The device according to claim 1, wherein the at least one electrical collector, on a front side of its externally threaded body, carries a contact provided for contacting the at least one longitudinally extending current conductor, wherein the contact is electrically insulated and connected with a lead leading out of the at least one slot.

13. The device according to claim 12, wherein the contact is designed as a spike axially projecting from the front side of the thread of the externally threaded body.

14. The device according to claim 12, wherein the contact is designed as at least one contact finger, pivotable about the geometric axis of the externally threaded body and projecting in a radial direction.

15. The device according to claim 1, wherein the at least one electric collector is a carrier for a lighting fixture.

16. A low voltage power supply device, comprising:

at least one elongated section-type conductor rail made of an electrically insulating synthetic material and at least two longitudinally extending current conductors which are arranged so as to be insulated from one another in at least one slot longitudinally extending along the at least one elongated section-type conductor rail, the at least one slot having two opposed side walls; and at least one electrical collector having an externally threaded body capable of being screwed into the at least one slot by engaging into the two opposed side walls of the at least one slot; wherein the at least one electrical collector further comprises at least one electrically conducing element which contacts one of the at least two longitudinally extending current conductors within the at least one slot when the respective collector is screwed into the at least one slot.

17. The device according to claim 16, wherein the two opposed side walls of the at least one slot comprise flutes following upon each other in the direction of the depth of the at least one slot and corresponding to a pitch of a thread of the externally threaded body, wherein the thread of the externally threaded body engages the flutes when being screwed into the at least one slot.

18. The device according to claim 16 or 17, wherein the at least two longitudinally extending current conductors are arranged each at a bottom part of one of the at least one slot.

19. The device according to claim 16 or 17, wherein the at least two of the longitudinally extending current conductors are arranged in a first one of the at least one slot.

20. The device according to claim 16 or 17, wherein a first one of the at least one slot is arranged adjacent to a second one of the at least one slot on one side of the at least one elongated section-type condutor rail.

21. The device according to claim 16 or 17, wherein the at least one elongated section-type rail has an approximately H-shaped cross-section in which a first one of the at least one slot faces away from a second one of the at least one slot.

22. The device according to claim 16 or 17, wherein the at least two longitudinally extending current conductors are arranged in a groove located in a first one of the two opposing side walls of the at least one slot and are positively retained in the groove by lateral undercuts.

23. The device according to claim 16 or 17, wherein the at least two longitudinally extending current conductors have an approximately circular cross-section and are positively held in a groove located in a first one of the two opposing side walls of the at least one slot, wherein the groove extends over an angle of more than 180° relative to the geometric axis of the at least two longitudinally extending current conductors.

24. The device according to claim 16, wherein the at least one electrical collector, on a front side of its externally threaded body, carries at least two contacts provided for contacting the at least two longitudinally extending current conductors, wherein the contacts each are connected with a lead leading out of the at least one slot.

25. The device according to claim 24, wherein the contacts are designed as contact fingers, pivotable about the geometric axis of the externally threaded body and projecting in a radial direction.

26. The device according to claim 24, wherein the at least one electric collector is a carrier for lighting fixture.

* * * * *